US007814981B2

(12) United States Patent
Marcu

(10) Patent No.: US 7,814,981 B2
(45) Date of Patent: Oct. 19, 2010

(54) FRACTURE VALVE AND EQUALIZER SYSTEM AND METHOD

(75) Inventor: Mihai Marcu, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 15 days.

(21) Appl. No.: 12/198,612

(22) Filed: Aug. 26, 2008

(65) Prior Publication Data

US 2010/0051291 A1 Mar. 4, 2010

(51) Int. Cl.
*E21B 43/26* (2006.01)
*E21B 34/08* (2006.01)

(52) U.S. Cl. ..... 166/308.1

(58) Field of Classification Search ..... 166/308.1, 166/386, 334.4, 177.5
See application file for complete search history.

(56) References Cited

U.S. PATENT DOCUMENTS 6,112,817 A 9/2000 Voll et al.
2007/0163781 A1* 7/2007 Walker ..... 166/313
2009/0044944 A1* 2/2009 Murray et al. ..... 166/308.1
2009/0139717 A1* 6/2009 Richard et al. ..... 166/278

OTHER PUBLICATIONS

Sunbul. A.H., et al. "Integrating Advanced Well Completion Technology Improved Well Performance and Maximized Recovery—Case History," SPE SA-0632, Society of Petroleum Engineers Symposium, Dhahran, Saudi Arabia: May 21-23, 2006.
Henriksen, K.H., et al. "Integration of New Open Hole Zonal Isolation Technology Contributes to Improved Reserve Recovery and Revision in Industry Best Practices,"SPE 97614, Society of Pretoleum Engineers, Luala Lumpur, Malaysia: Dec. 5-6, 2005.
"Equalizer CF", Sand Control Systems, Baker Oil Tools Product Report, Product Family No. H48688, Nov. 2005.
"Equalizer Screen", Sand Control Systems, Baker Oil Tools Product Report, Product Family Nos. H48692 and H48693, Jun. 2005.

* cited by examiner

*Primary Examiner*—William P Neuder
(74) *Attorney, Agent, or Firm*—Cantor Colburn LLP

(57) ABSTRACT

Disclosed herein is an equalizer and fracture valve system. The system includes, a tubular, at least one fracture valve disposed at the tubular is openable and closeable to flow therethrough, and at least one equalizer disposed at the tubular is openable to flow therethrough.

18 Claims, 3 Drawing Sheets

FRACTURE VALVE AND EQUALIZER SYSTEM AND METHOD

BACKGROUND OF THE INVENTION

In the hydrocarbon recovery industry it is desirable to maintain high production rates of hydrocarbons while minimizing production of other fluids, such as water, for example. Earth formations with low permeability can restrict the flow and consequently, the production of hydrocarbons. To increase the permeability of an earth formation, operators often fracture the formation with pressure. To do so, an operator needs to be able to open a fracture valve to expose a portion of a downhole formation to pressure supplied through a tubular, such as a drillstring or a production string, for example. Closure of the fracture valve upon completion of the fracture operation could allow the operator to perform additional operations.

One such operation is to equalize or balance production across various portions of a well to prevent producing excess undesirable fluids that may breakthrough in portions of the well while not breaking through in other portions. Equalizers are used for this purpose. Typical systems require an operator to run separate drillstrings or production strings to perform the fracturing and the equalizing. Operators would be receptive to systems that permit fracturing and equalizing with the running of a single drillstring or production string.

BRIEF DESCRIPTION OF THE INVENTION

Disclosed herein is an equalizer and fracture valve system. The system includes, a tubular, at least one fracture valve disposed at the tubular is openable and closeable to flow therethrough, and at least one equalizer disposed at the tubular is openable to flow therethrough.

Further disclosed herein is a method of actuating valves at a downhole tubular. The method includes, moving an insert and a sleeve to open a fracturing valve while leaving an equalizer valve closed, and moving the insert to close the fracturing valve while opening the equalizer valve.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1A:
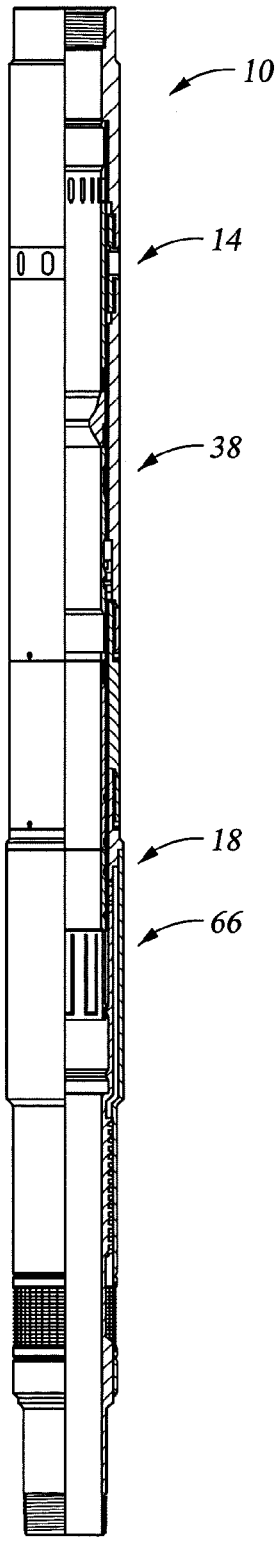
FIGS. 1A-1C depict quarter cross sectional views of an embodiment of an equalizer and fracture valve system disclosed herein at various configurations.
Figure 1B:
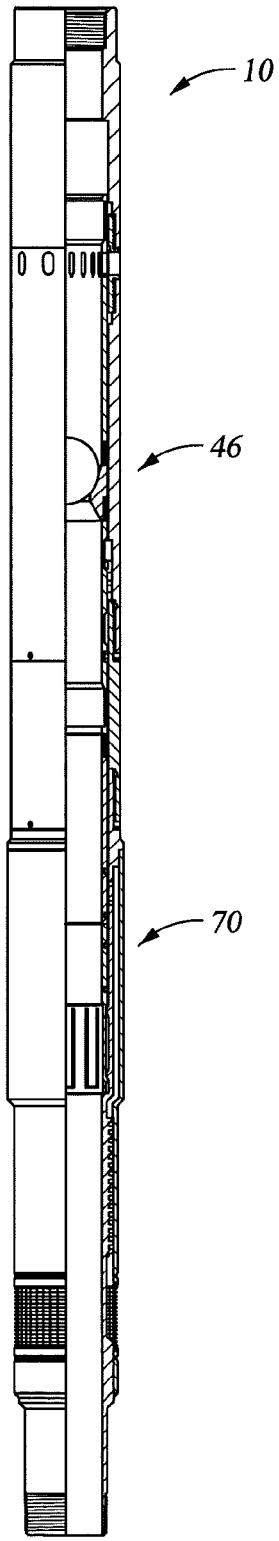
Figure 1C:
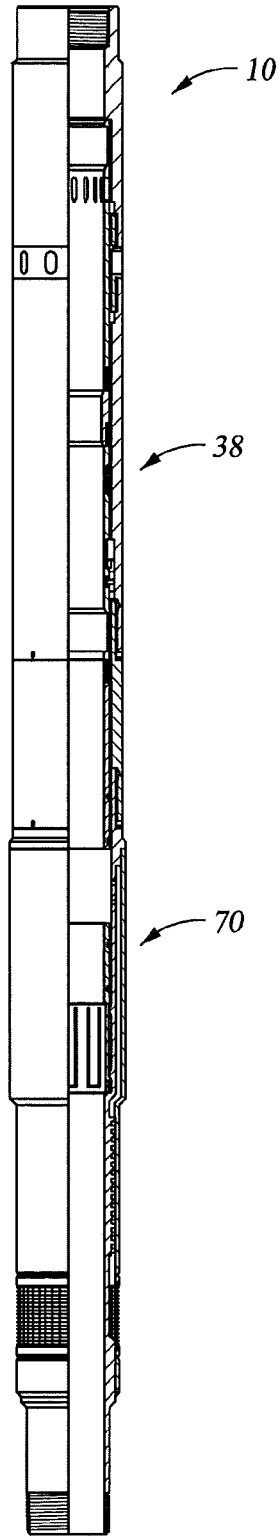

Referring to FIGS. 1A-1C an embodiment of drillstring or production string 10 having an equalizer and fracture valve system 12 disclosed herein is illustrated. Among other things, the system 12 includes a fracture valve 14 and an equalizer 18. In FIG. 1A both the fracture valve 14 and the equalizer 18 are in a closed configuration. In FIG. 1B the fracture valve 14 is open while the equalizer 18 is closed. And in FIG. 1C the fracture valve 14 is closed while the equalizer 18 is open. The system 12 is described in greater detail with reference to FIG. 2 below.

Figure 2:
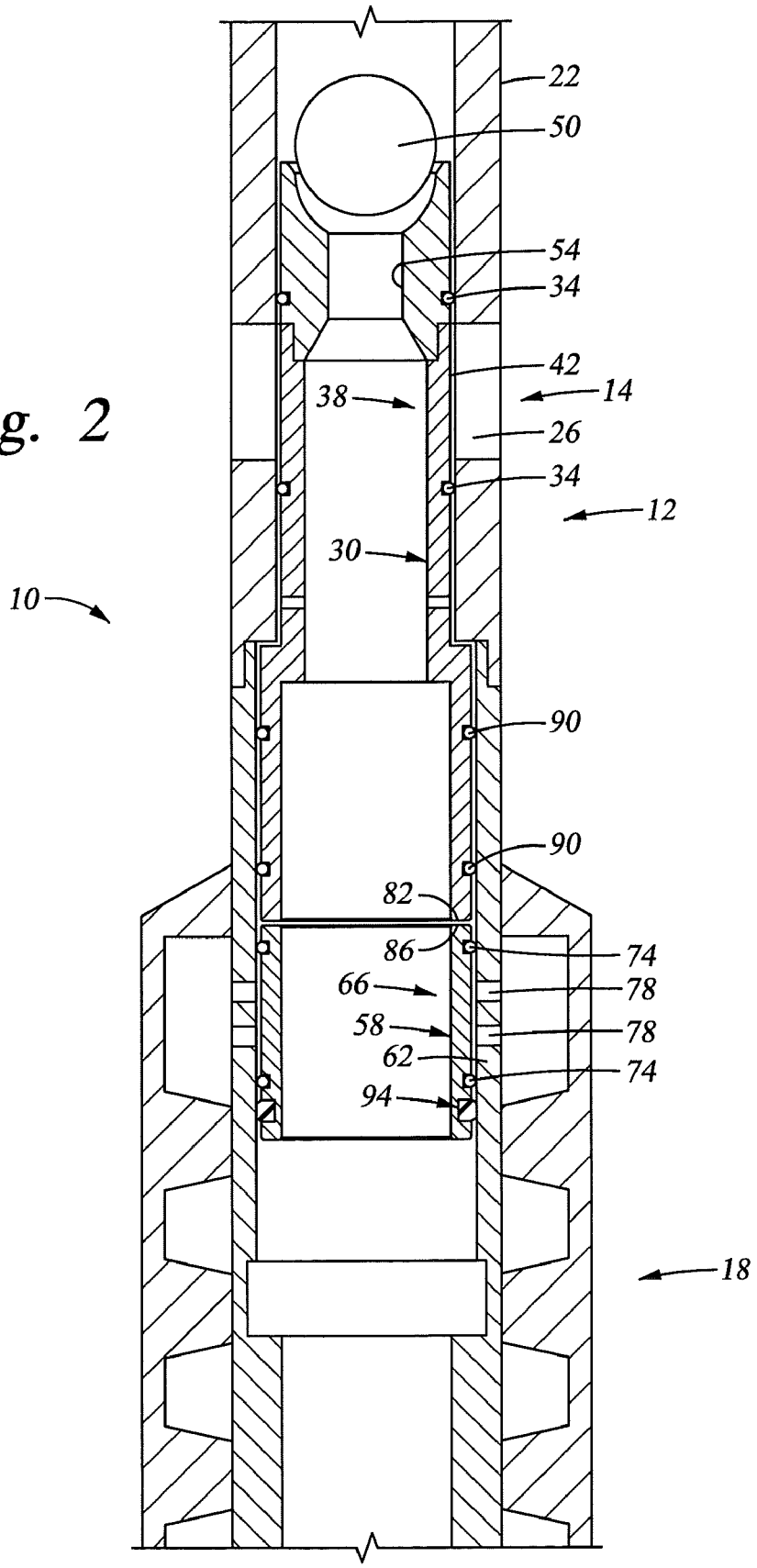
FIG. 2 depicts a cross sectional view of the equalizer and fracture valve system of FIGS. 1A-1C.

Referring to FIG. 2 the fracture valve 14 is positioned along a tubular 22, such as a drillstring or production string, for example. The fracture valve 14 includes at least one opening 26, disclosed herein as a port, through the tubular 22, and an insert 30 that is sealably engaged with the tubular 22 by seals 34, shown here as o-rings. The insert 30 is movable, relative to the tubular 22 such that while in a first position 38, the first position 38 being an upper position in this embodiment, the o-rings 34 straddle the port 26 thereby sealing the port 26 to a wall 42 of the insert 30. And, while the insert 30 is in a second position 46, the second position 46 being a lower position in this embodiment, the o-rings 34 are both positioned to a same side of the port 26 thereby opening the fracture valve 14 to fluid flow therethrough.

Movement of the insert 30 between the first position 38 and the second position 46 is achieved, in this embodiment, by pressure supplied from surface via the tubular 22. The pressure builds up on an uphole side of a ball 50 dropped to a ball seat 54 of the insert 30. The built up pressure forces the ball 50, the ball seat 54, and the insert 30 to move from the first position 38 to the second position 46. As such, an operator can reconfigure the fracture valve 14 from a closed configuration to an open configuration by dropping the ball 50 and pressuring up until the fracture valve 14 opens. Once the fracture valve 14 is open an operator can supply pressure to a formation through the open fracture valve 14, until the formation fractures. Once the formation has fractured an operator is then able to flow proppant into the formation fracture to hold the fracture open even after the supplied pressure is removed.

Closing of the fracture valve 14 is accomplished by moving the insert 30 from the second position 46 to the first position 34. One way to move the insert 30 in this manner is by removing the ball 50 (and optionally the ball seat 54), to permit a shifting tool (not shown) to engage the insert 30, to move the insert 30 with the shifting tool. The ball 50 and the ball seat 54 can be removed by methods, such as through drilling, for example.

Movement of the insert 30 from the first position 38 to the second position 46 also causes a sleeve 58, which is sealingly engaged with a wall 62 of the equalizer 18, to move from a first location 66 to a second location 70. Seals 74, shown as o-rings, straddle the openings 78 in the wall 62, thereby deadheading the opening(s) 78 to the sleeve 58, in response to the equalizer 18 being closed when the sleeve 58 is in the first location 66. A surface 82 of the insert 30 contacts a surface 86 of the sleeve 58 to move the sleeve 58 downward when the insert 30 is moved downward as disclosed herein. With the foregoing construction, however, movement of the insert 30 from the second position 46 to the first position 38 does not cause the sleeve 58 to move from the second location 70 to the first location 66, since the surfaces 82 and 86 simply move away from one another during such action.

The insert 30 also sealingly engages with the wall 62, of the equalizer 18, with seals 90, disclosed herein as o-rings. The seals 90 are configured such that they are on a same side of the opening(s) 78 when the insert is in the first position 38 and they straddle the opening(s) 78 when the insert 30 is in the second position 46. As such, when the insert 30 is moved from the first position 38 to the second position 46, the sleeve 58 is moved from the first location 66 to the second location 70. During this movement the opening(s) 78 go from being deadheaded by the sleeve 58 to being deadheaded by the insert 30. The equalizer 18 thereby remains closed as the fracture valve 14 is opened.

An operator can, therefore, float the drillstring or production string 10, disclosed hereinabove, downhole since both the fracture valve 14 and the equalizer 18 are closed with the insert 30 in the first position 38 and the sleeve 58 in the first location 66. A force failing member 94, shown as a lock ring, can be used to prevent inadvertent movement of the sleeve 58 and the insert 30 until a selected force is achieved. Once the drillstring or production string 10 is set in the desired downhole position, the ball 50 can be dropped to the ball seat 54. Pressure can then be built above the ball 50 to force the insert 30 from the first position 38 to the second position 46, while simultaneously forcing the sleeve 58 from the first location 66 to the second location 70, thereby opening the fracture valve 14 while leaving the equalizer 18 closed. After pressuring up to fracture a formation the ball 50, and ball seat 54, can be removed and the insert 30 moved back to the first position 38, thereby closing the fracture valve 14 while simultaneously opening the equalizer 18 for balanced production therethrough.

At a later time, during the life of the well, an operator can as well chose to re-close the equalizer 18 and prevent any communication between the well bore and the inside of the drillstring or production string 10 if, for example, undesirable fluids had broken through that particular section of the well. Re-closing of the equalizer 18 is accomplished by engaging the sleeve 58 with a shifting tool (not shown) and moving it upward from the location 70 to the location 66.

The disclosed device allows an operator to selectively fracture multiple zones of a well and then produce each of the multiple zones through an equalizer without having to run more than one drillstring or production string. To do so the operator constructs multiple sets of the fracture valves 14 and equalizers 18, disclosed herein, along a length of drillstring or production string 10 with the internal dimensions of each successive set of fracture valve 14 and equalizer 18, in a downhole direction, in this embodiment, being smaller in diameter. With such, the operator can drop balls of increasing size to sequentially actuate each fracture valve 14 in ascending order. Annulus isolating devices such as packers (not shown) may be used along the drillstring or production string 10 to create the multiple zones in the wellbore.

Figure 3:
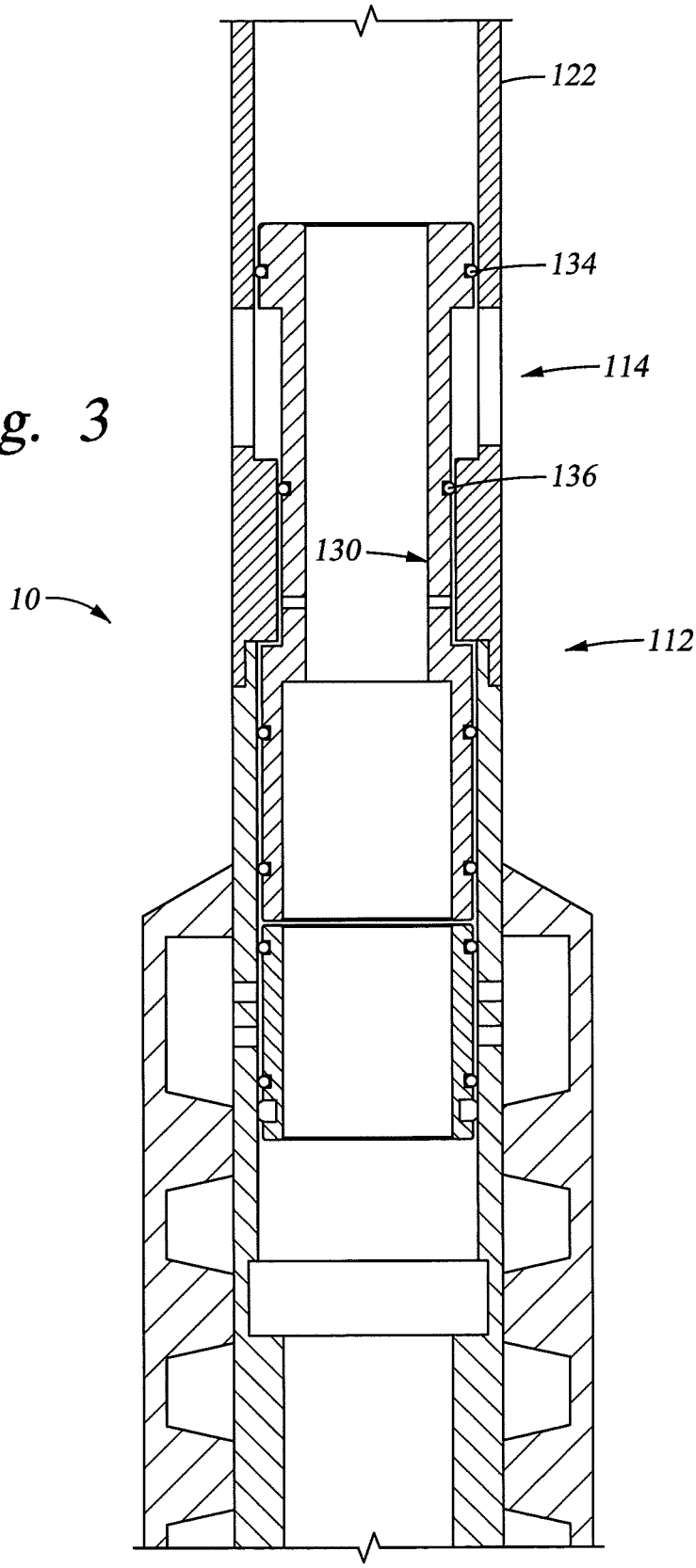
FIG. 3 depicts a cross sectional view of an alternate embodiment of an equalizer and fracture valve system disclosed herein.

Referring to FIG. 3 an alternate embodiment of an equalizer and fracture valve system 112, disclosed herein, is illustrated on the drillstring or production string 10. The system 112 is similar to the system 12 and as such the like elements are numbered with the same reference characters. A primary difference between system 112 and system 12 is, instead of pressuring up against the ball 50 on the ball seat 54 to move the insert 30, the system 112 pressures up against an insert 130 directly. In doing so the insert 130 acts as a piston. In order for the insert 130 to act as a piston a difference in area between a higher pressure and a lower pressure needs to exist. This difference in area is generated by a difference in diameter between a first seal 134 and a second seal 136 that seal the insert 130 to a tubular 122 of a fracture valve 114. When the drillstring or production string 10 is sealed downhole of the system 112, pressure within the drillstring or production string 10 acts on the insert 130 directly. If the diameters of the seals 134 and 136 were identical, then the pressure would only cause a force radially outwardly on the insert 130. The differences in the areas between the seals 134 and 136, however, cause an axial force that allows the insert 130 to act as a piston and move in response to a pressure differential, to actuate the opening of the fracture valve 114. The remaining actuation of the system 112 mimics that of the system 12 and will not be repeated here.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An equalizer and fracture valve system, comprising:

a tubular;

at least one fracture valve disposed at the tubular being openable and closable to flow therethrough;

at least one equalizer disposed at the tubular being openable to flow therethrough; and a mechanism configured to permit opening of only one of the equalizer and the fracture valve at any one time.

2. The equalizer and fracture valve system of claim 1, wherein the fracture valve is openable in response to pressure applied within the tubular.

3. The equalizer and fracture valve system of claim 1, wherein the mechanism is an insert and the fracture valve is openable and closable in response to movement of the insert.

4. The equalizer and fracture valve system of claim 3, further comprising a ball seat disposed at the insert and receptive of a ball.

5. The equalizer and fracture valve system of claim 3, further comprising a sleeve, the equalizer being openable and closeable in response to positions of the insert and the sleeve in relation to the equalizer.

6. The equalizer and fracture valve system of claim 5, wherein the sleeve is movable in response to movement of the insert.

7. The equalizer and fracture valve system of claim 5, further comprising a force failing member in operable communication with the sleeve such that failure of the force failing member allows movement of the sleeve.

8. The equalizer and fracture valve system of claim 3, wherein the insert is configured to act as a piston in response to a pressure differential across the tubular.

9. The equalizer and fracture valve system of claim 1, further comprising a plurality of fracture valves and equalizers configured in sets along the tubular.

10. The equalizer and fracture valve system of claim 9, wherein internal dimensions of each successive set in a downhole direction is of a smaller diameter.

11. The equalizer and fracture valve system of claim 1, wherein the tubular is floatable into a wellbore while the at least one fracturing valve and the at least one equalizer are closed.

12. A method of actuating valves at a downhole tubular, comprising:

moving an insert and a sleeve to open a fracturing valve while leaving an equalizer valve closed; and moving the insert to close the fracturing valve while opening the equalizer valve.

13. The method of actuating valves at a downhole tubular of claim 12, wherein the moving of the insert and the sleeve to open the fracturing valve is in a downhole direction and the moving of the insert to close the fracturing valve is in a uphole direction.

14. The method of actuating valves at a downhole tubular of claim 12, wherein the moving of the insert and the sleeve to open the fracturing valve includes dropping a ball to the insert, and building pressure above the ball to urge the insert to move.

15. The method of actuating valves at a downhole tubular of claim 14, wherein the moving the insert to close the fracturing valve while opening the equalizer valve includes removing the ball and a ball seat and lifting the insert.

16. The method of actuating valves at a downhole tubular of claim 15, wherein the removing the ball and the ball seat includes drilling the ball and the ball seat.

17. The method of actuating valves at a downhole tubular of claim 12, further comprising moving the sleeve to close the equalizer while leaving the fracturing valve closed.

18. The method of actuating valves at a downhole tubular of claim 17, wherein the moving the sleeve to close the equalizer is in an uphole direction.

* * * * *